United States Patent [19]

Napierski

[11] Patent Number: 4,622,876

[45] Date of Patent: Nov. 18, 1986

[54] CUTTING DEVICE FOR CRESTED CUTTING OF FRUITS AND THE LIKE

[76] Inventor: Reinhard Napierski, Talstrasse 18, 6361 Niddatal 1, Fed. Rep. of Germany

[21] Appl. No.: 728,222

[22] Filed: Apr. 29, 1985

[30] Foreign Application Priority Data

Apr. 27, 1984 [DE] Fed. Rep. of Germany ..... 3415691

[51] Int. Cl.[4] ..... B26D 5/16

[52] U.S. Cl. ..... 83/618; 83/628; 83/925 R

[58] Field of Search ..... 83/618, 620, 628, 193, 83/194, 925 R

[56] References Cited

U.S. PATENT DOCUMENTS 4,151,769 5/1979 Binnie ..... 83/194 X

FOREIGN PATENT DOCUMENTS 2369029 6/1978 France ..... 83/194

*Primary Examiner*—Frank T. Yost

*Attorney, Agent, or Firm*—Larson and Taylor

[57] ABSTRACT

The cutting device for crested cutting of fruits and the like has a plurality of V-shaped knives (14) arranged in star arrangement around a fruit holder (18). These rest movably on roof-shaped guide surfaces (20), are reinforced by guide members (20) and through them are connected with catches (24). Countersurfaces (at 26, 30, 32) to guide surfaces (20) are found on one or both outside housing parts (10, 12) and hold knives (14) in position on guide surfaces (20). Catches (24) engage in spiral grooves in rotatable top housing part (12).

11 Claims, 12 Drawing Figures

CUTTING DEVICE FOR CRESTED CUTTING OF FRUITS AND THE LIKE

Figure 2:
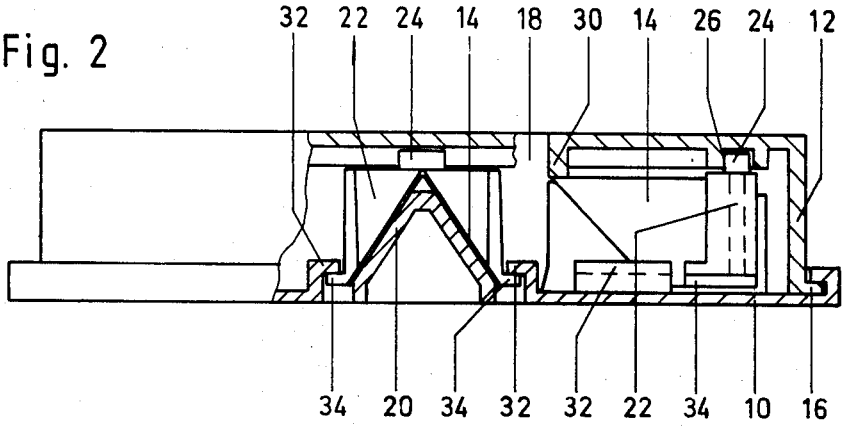

The invention relates to a cutting device for crested cutting of fruits and the like, using knives of essentially V-shaped cross section, arranged in a star arrangement around a fruit holder, wherein the cutting blades are guided to slide between radially extending guide surfaces of a first housing part, which are similar to a gabled roof, and at least one countersurface on the housing, and then, by means of a catch arranged on each knife, to mesh in a spiral groove of a second housing part which rotates relative to the first housing part, so that they can be moved by rotating both housing parts relative to each other radially along the guide surfaces.

In such a cutting device, it is known to guide the V-shaped knives between guide surfaces on the bottom part of the housing which are similar to a gabled roof and engage the inside surfaces of the knives, and countersurfaces on a separate housing midsection, which engages the outide surfaces of the knives and is provided with radial slots, through which the catches project into spiral grooves in the rotatable top of the housing (DE-PS No. 23 32 131). One drawback of this is the manufacturing cost of the additional, quite large housing midsection which is required, the complicated cleaning and the fact that the complicated construction practically cannot guarantee that the knife is stably controlled and guided, because the only consideration is to have the largest possible guide surface for the knife, but not that the guide surfaces must be as rigid as possible.

Another known cutting device uses V-shaped knives sliding in V-shaped guides in the bottom part of the housing with guide members inserted on the radial outside end with catches projecting upward from there, which project through radial slots the top nonrotatable housing part so that operation members, such as e.g. a draft cable or operation lever, can engage thereon and move them radially (DE-GM No. 1 878 496). Also, this construction is quite complicated and correspondingly difficult to clean, because in addition to the knives and both housing parts, other additional operation members are also present. Also, the radial inside knife ends can likewise come upward and pull away, and if the knives lose their smooth contact on the guide surfaces, they can also bend and lock because their material is weak.

Still another known cutting device (U.S. Pat. No. 3,190,330) can be used, in which the V-shaped knives are connectd with a guide member only at the rear, and moved by a spiral groove along a radial groove. No gabled-roof-like guide surfaces and countersurfaces are present, between which the radial inner end and the middle area of the cutting blades are guided. Because they are held freely cantilevered, and thus inclined to tilt, the knives can be moved only with difficulty. Also, assembly and disassembly of the apparatuses are very inconvenient.

The object of the invention is to disclose a cutting device of the above type in which the cutting blades are stably guided between guide surfaces and countersurfaces, with a simple, easy to clean, two-part housing.

The above object is attained according to the invention in that at least one countersurface is configured on at least one of the two housing parts which can be rotated relative to each other.

The advantage of the simplicity of the new cutting device above all resides in assigning the second, preferably the top, housing part, two simultaneous functions, i.e. both the direct pressing of the knife to the guide surfaces of the bottom part of the housing and also the radial drive of the knife. No radial guide slots are required for the catches under these conditions.

The knife can be held in contact with the guide surfaces in the cutting device according to the invention, in that the knives themselves and/or guide members connected with the knives engage slidingly on countersurfaces on the first housing part, which extend parallel to the guide surfaces. A very good knife guide is thus obtained, because in this case the shortest and strongest connection exists between the guide surfaces which are like a gable roof and the countersurfaces. Another possibility of holding the knives in contact with the guide surfaces resides in that they preferably engage on the top housing part with their outside apexes and/or the top side of a guide member connected with it sliding on a countersurface on the second housing part, and this countersurface lies in a radial plane of the rotary axis and preferably extends to the radial inside edge of the top housing part. With this bracing of the apex, it is advantageous that the knives be reinforced by outside reinforement ribs or guide members. Also, the rigidity of the guidance can be improved in that the top housing part is reinforced both by inside tip-stretched guide ribs, which define the spiral grooves, and also by a configuration of its radial inside end edge, which is as much as possible like a shrouded ring, which serves as a brace for the apex of the knife. Countersurfaces can also be present on both housing parts.

The knives can be of steel with outide reinforcement ribs or reinforced plastic guide members. They can also be manufactured totally of one piece, together with a plastic reinforcement rib or member, which can also serve as guide member, and it is recommended to configure the shank of the knife with lengthwise ribs or stiffening corrugations.

It could be that the specially advantageous embodiment with guide surfaces and countersurfaces on the same housing part has not been suggested until this time because no possibility could be imagined for their manufacture with facing surfaces extending to several sides in the injection molding method. However, it has been discovered that this is possible if the countersurfaces lie over apertures in the base plate of the bottom part of the housing, because then the countersurfaces can be formed through the apertures in the base plate.

Figure 1:
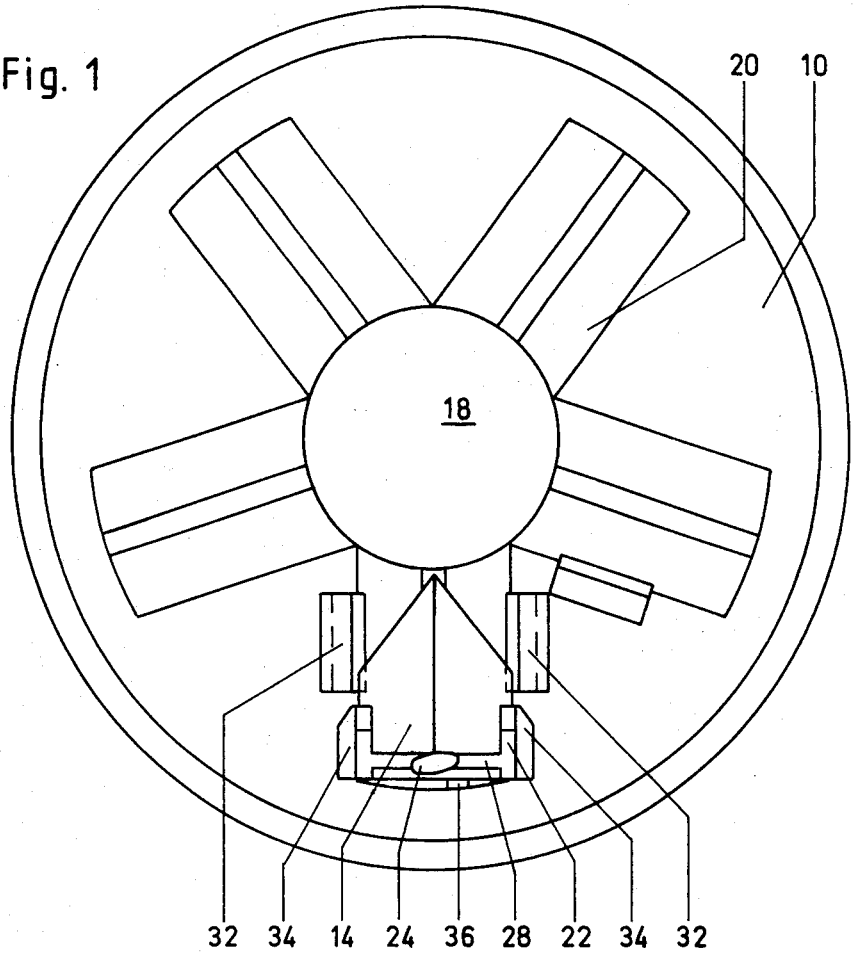
Figure 7:
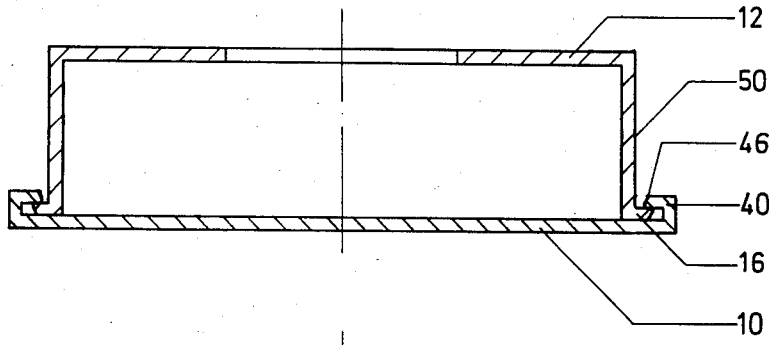
Figure 8:
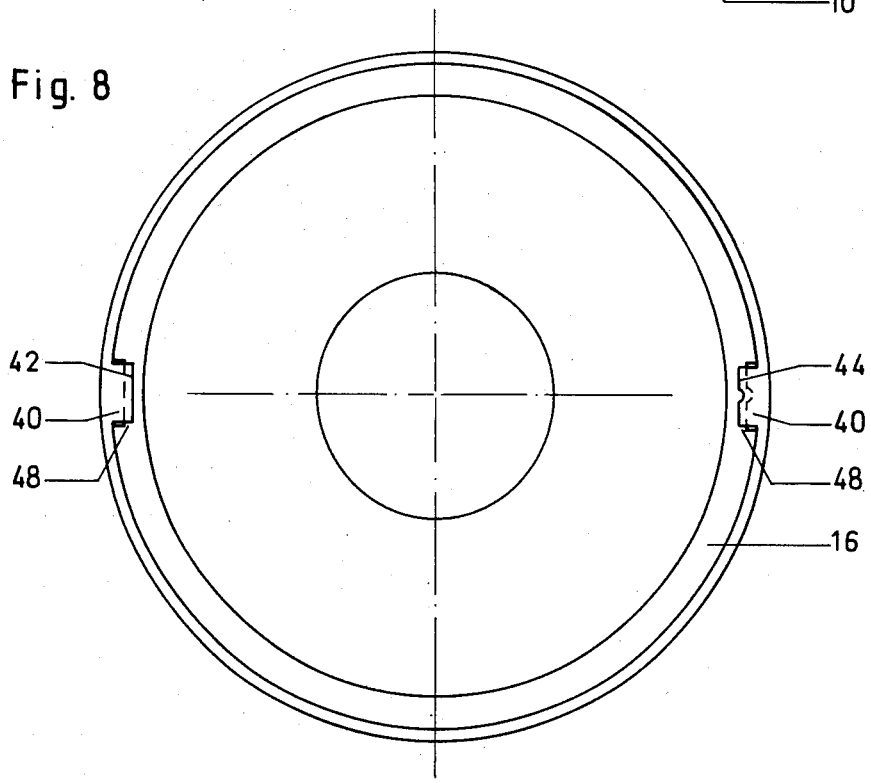

The invention is explained more clearly hereinafter relative to the exemplary embodiment shown in the drawing. The drawings show:

FIG. 1, a plan view of a cutting device according to the invention following removal of the top part of the housing;

FIG. 2, a cross section through the cutting device of FIG. 1, so that one of the blades is shown in transverse cross section and another in lengthwise cross section;

FIGS. 3 to 6, cross sections and side views of various knives and guide members;

FIGS. 7 and 8, one diagrammatic cross section and one plan view of the cutting device to show the mesh-locking connection between housing parts.

The cutting device shown in FIGS. 1 and 2 consists only of a round bottom housing part 10, a cup-shaped top housing part 12 to be fitted thereto on the outside periphery, rotatably relative thereto, and in this example, five V-shaped knives 14, i.e. seven separate parts in all. FIG. 2 shows the outside edge of bottom housing part 10 with a flange edge 16 with recesses on top housing part 12, which allows a sort of bayonette connection in a certain relative angular position in the contact edge of bottom housing part 10.

Bottom housing part 10 in the example has essentially the same shape as the bottom housing part of DE-PS No. 23 32 131, with a central saucer-like fruit holder 18 and neighboring gabled-roof-like projections or points 20 in a star configuration. The apex of roof-shaped point 20 corresponds to the apex of the V-shaped knife 14, since these rest radially movable on the roof-like points 20. The side surfaces of points 20 can be configured with notches or recesses, so that the knife is not engaged on its whole inside surface.

On their outside ends, knives 14 are connected tightly on the outside with a guide member 22 or are configured integrally with this. This guide is tightly connected with catches 24 in the middle on its top side or is configured integrally with them. As shown in FIG. 2, catches 24 each mesh into a spiral groove 26 on the bottom of the top housing part 12, so that with rotation of the top housing part relative to bottom housing part 10, catches 24 slide along the spiral grooves and the knives are thus moved along radial points 20.

The stable guidance of knives 14 pointed in toward the radial inside apex in the customary manner as in the example shown in FIGS. 1 and 2 serves several purposes. Since the V-shaped knives engage with their large inside surfaces on the roof-shaped guide surfaces of points 20, the countersurfaces to the roof-shaped guide surfaces are essentially a support for th eknives, so that the knives, impacting against the resistance of harder fruits during the cutting, cannot tip away with their radial inside ends upward from the roof-shaped guide surfaces.

The bottom surface of the ribs on the bottom of top housing part 12 serves as a first countersurface, which limits spiral groove 26. The top surface 28 of guide member 22 engages slidingly on this surface.

A second countersurface is found on the radial inside edge of top housing part 12 directly on the edge of fruit holder 18. Housing top part 12 there forms a collar 30 extending annularly around fruit holder 18, facing downward, on the bottom surface of which engage the apexes of knives 14. Collar 30 works similar to the ribs limiting spiral grooves 26, improving the rigidity and shape stability of top housing part 12 while it is being pressed by the knives during cutting.

Finally, in the exemplary embodiment of FIGS. 1 and 2, third countersurfaces are provided in the area of the ends of the shanks of the V-shaped knives. For this purpose, guide rails 32 are found next to roof-shaped points 20 on both sides, into which engage tip-stretched fillets 34 at the bottom of guide members 22, projecting outward. Fillets 34 in the exemplary embodiment of FIG. 2 are found entirely at the ends of the shanks of knives 14. Each bottom of a guide rail 32, on which the top side of fillets 34 engage sliding, forms the countersurface to the roof-shaped guide surfaces, on which lie knives 14. Beneath the countersurface on guide rails 32, the base plate of bottom housing part 10 has apertures, very greatly simplifying the forming of the countersurfaces on guide rails 34.

The countersurfaces to the roof-shaped guide surfaces should be made as far radially inside as possible. This is true not only for the countersurface on collar 30 but also for guide rails 32. However, there is also the possibility that guide rails 32 extend over essentially the entire length of points 20.

Normally, the countersurfaces on guide rails 32 suffice, so that additional countersurfaces on collar 30 and on the ribs limiting the spiral grooves 26 are not required. One could also, however, delete guide rails 32 and work only with countersurfaces effective at the top, in the area of the apex of the knife.

Another advantageous feature of the cutting device arises from FIG. 1, wherein catch 24 has an oval shape, which lies oblique to the radial and tangential direction so that an especially large surface on spiral groove 24 is obtained.

Figure 3A:
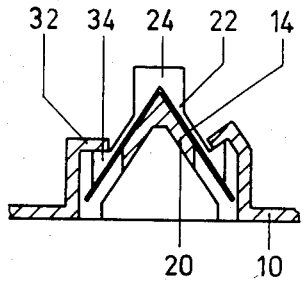
Figure 3B:
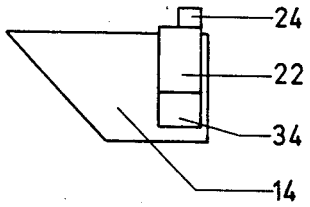
Figure 4A:
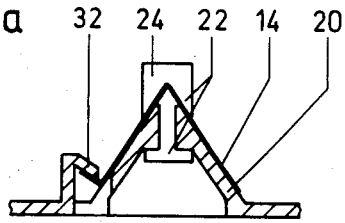
Figure 4B:
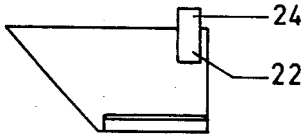
Figure 6A:
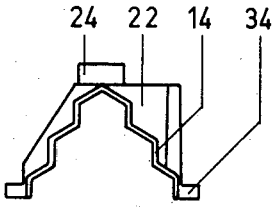
Figure 6B:
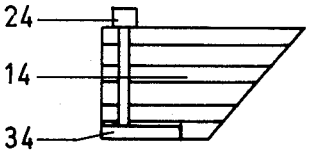

FIGS. 3*a*, 4*a* and 6*a* show different shapes of knives 14 to the right and left of the midline, and FIGS. 3*b*, 4*b* and 6*b* show each one of the two in the associated drawings in transverse cross section and also in side view. The knives in the right and left side views of FIG. 3*a* differ by the cross sectional shape of the projecting fillets 34 at the bottom end of guide member 22. On the left side of FIG. 3*a*, fillet 34 has a top outside edge bent at a right angle, and on the right side, has an acutely angled outside edge. Guide rails 32 are also of correspondingly different shapes. In FIG. 3*b*, guide member 22 is molded with fillets 34 at some distance from the radial outside edge of the knife and from the ends of its shanks. The maintenance of some distance from the end edges of the knife guarantees a simpler and improved packing of the injection mold.

In knife 14 shown on the right side of FIG. 4*a*, there is an outside support on the shank end. Countersurfaces are found only in the area of the apex of the knife, and in this case guide member 22 extends through holes in the apex area of the knife and abutts on the bottom of the bottom housing part. In this case, roof-shaped points 20 have a middle lengthwise slot.

The knife shown on the left side of FIG. 4*a* and in FIG. 4*b* in side view has shank ends bent outward, engaging directly on the countersurfaces on the bottoms of guide rails 32.

Figure 5A:
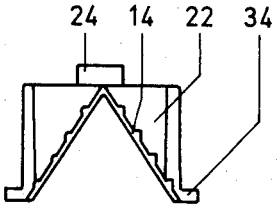
Figure 5B:
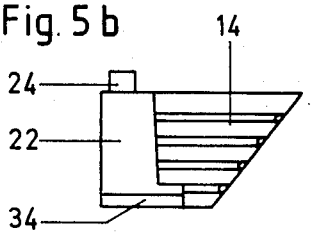

FIGS. 5 and 6 show knives which are manufactured of plastic and are integral with guide members 22. The guide members can thus be similarly formed as in the configuration of FIGS. 1 and 2. Knives 14 are provided with various lengthwise ribs for reinforcement in the embodiment of FIGS. 5*a* and 5*b*, and with lengthwise stiffening corrugations in the embodiment of FIGS. 6*a* and 6*b*.

Without further discussion it is clear that still numerous other variations of embodiment can be applied to the construction of the knives and guide members and correspondingly also to the countersurfaces cooperating with them, on the roof-shaped guide surfaces. If there is no knife guidance by countersurfaces on top housing part 12 or guidance occurs only on the radial inside edge at 30, guide member 22 can be deleted or be reduced to a reinforcement rib.

It is recommended to provide a projecting stop 36 (FIG. 1) on each roof-shaped guide surface, which provides that if knives 14 engage thereon, during assembly of the apparatus catches 24 will enter spiral grooves 26.

With a cutting device of the described basic structure, in which a top housing part is mounted on a bottom housing part, and the knives are operated simultaneously, irrespective of whether the knives are guided as described above or in another manner, there is the problem that the top housing part is raised from the bottom housing part by operational pressure. Until this time, two clamps have been used at two points offset 180° from each other to counter this, which clamps held the top housing part and the bottom housing part together. The drawback of these additional two clamps is not only the additional manufacturing cost but also the costly assembly. FIGS. 7 and 8 show a connection of the housing parts without such clamps.

Two fastenings 40 are formed on bottom housing part 10, overlapping flange edge 16 of top housing part 12 in snapped-in or mesh-locked state, and hold it axially while rotatably guiding it. The two fastenings 40 have different inside contours 42 and 44 and bevels 46.

The edge 16 of top housing part 12 has two opposite mesh-locking areas 48 in the form of recesses which are configured differently, corresponding to the two contours 42 and 44. The inside edges of mesh-locking areas 48 however lie on a periphery which is about 1.5 mm larger than contours 42, 44 of bottom housing part 12. This allows the correct assembly position to be found easily, and top housing part 12 is so rotated that contours 42, 44 and mesh-locking area 48 coincide, and a simple mesh-locking is also attained, by simply pressing on top housing part 12 in the adjusted position on bottom housing part 10. The inside edges of mesh-locking area 48 first meet the bevel 46, and from there are pressed inward and then spring-fitted under fastenings 40. In mesh-locked state, top housing part 12 can be freely rotated in order to operate the knives in the aforementioned or in a known manner. To release the connection, it suffices to rotate housing parts 10 and 12 into those positions in which fastenings 40 are found in the mesh-locking areas 48, and then to press on peripheral surface 50 of top housing part 12 and to lift it.

I claim:

1. A cutting device for the crested cutting of fruits and the like comprising:

a fruit holder;

a plurality of knives arranged radially in a star arrangement around said fruit holder, each said knife having a V-shaped cross section and a cutting blade;

a first housing part including gable-roof-shaped guide surfaces on which corresponding said knives are slidingly guided for radial movement;

a second housing part which is rotatable relative to said first housing part;

a radial moving means for moving said knives radially along respective said guide surfaces by relative rotation of said first housing part and said second housing part including a catch arranged on each said knife and respective spiral grooves in said second housing part meshing with a respective said catch; and at least one guide countersurface for each said knife provided on one of said first housing part and said second housing part on which corresponding said knives are slidingly guided for radial movement such that said knives are constrained for radial movement only by said guide surfaces and countersurfaces.

2. A cutting device as claimed in claim 1 wherein said countersurfaces are located on said second housing part and extend in a radial plane such that said countersurfaces engage a respective apex said V-shaped knives.

3. A cutting device as claimed in claim 2 wherein said countersurfaces are a circular collar attached to said second housing part and forming a radial inside edge of said second housing part.

4. A cutting device as claimed in claim 1 wherein said countersurfaces are mounted on said first housing part and are parallel to said guide surfaces.

5. A cutting device as claimed in claim 4 and further including apertures in said first housing part, and wherein each respective said countersurface lies over a respective said aperture.

6. A cutting device as claimed in claim 1 and further including at least one reinforcement rib on the outside of each V-shaped cutting blade.

7. A cutting device as claimed in claim 6 wherein said at least one reinforcement rib includes at least one rib surface which engages said countersurface such that said at least one rib forms a guide member for each respective said knife.

8. A cutting device as claimed in claim 6 wherein said cutting blades and said guide member are formed of plastic.

9. A cutting device as claimed in claim 6 wherein one of said cutting blades and said guide members is formed of plastic.

10. A cutting device as claimed in claim 1 wherein said catches have an oval transverse cross section with the lengthwise axis of each said oval catch oblique to a radial axis of a respective said knife such that a larger contact surface is provided on each said catch with respect to the respective said spiral groove in which said catch is located.

11. A cutting device as claimed in claim 1 wherein said first housing part includes a circular flange edge around the periphery thereof, said flange edge including two opposite recesses therein which form mesh-locking areas; and wherein said second housing part includes a circular peripheral wall surrounding said flange edge and two opposite fastenings extending from said flange edge and overlapping said flange edge during operation and whereby prior to operation said fastenings are mesh-locked by elastic deformation at said mesh-locking areas into position overlapping said flange edge.

* * * * *